US006252478B1

(12) United States Patent
Gruner

(10) Patent No.: US 6,252,478 B1
(45) Date of Patent: Jun. 26, 2001

(54) ELECTROMAGNETIC RELAY

(76) Inventor: Klaus A. Gruner, 1275 Broadway, Village of Lincolnwood, IL (US) 60014

( * ) Notice: Subject to any disclaimer, the term of this patent is extended or adjusted under 35 U.S.C. 154(b) by 0 days.

(21) Appl. No.: 09/427,328

(22) Filed: Oct. 26, 1999

Related U.S. Application Data

(63) Continuation-in-part of application No. 09/244,925, filed on Feb. 4, 1999, now abandoned.

(51) Int. Cl.[7] ..... H01H 51/22; H01H 67/02
(52) U.S. Cl. ..... 335/78; 335/83; 335/129
(58) Field of Search ..... 335/78–86, 124, 335/128, 129, 130

(56) References Cited

U.S. PATENT DOCUMENTS 4,518,943 * 5/1985 Giessner ..... 337/68
4,886,641 * 12/1989 Iwamura et al. ..... 420/470
5,160,910 * 11/1992 Tsuji ..... 335/129
5,250,919 * 10/1993 Schedele ..... 335/128
5,519,370 * 5/1996 Perreira et al. ..... 335/154

* cited by examiner

*Primary Examiner*—Licoln Donovan
*Assistant Examiner*—Tuyen Nguyen
(74) *Attorney, Agent, or Firm*—Charles F. Meroni, Jr.; Meroni & Meroni, P.C.

(57) ABSTRACT

An electromagnetic relay having a motor assembly with a bobbin secured to a frame. A core is disposed within the bobbin except for a core end which extends from the bobbin. An armature end magnetically engages the core end when the coil is energized. An actuator engages the armature and a plurality of movable blade assemblies. The movable blade assembly is comprised of a movable blade ultrasonically welded onto a center contact terminal. A normally open blade is positioned relatively parallel to a movable blade. The normally open blade is ultrasonically welded onto a normally open terminal to form a normally open contact assembly. A normally closed contact assembly comprised of a third contact rivet and a normally closed terminal. A normally closed contact assembly is vertically positioned with respect to the movable blade so that the normally closed contact assembly is in contact with the movable blade assembly when the movable blade is not being acted upon by the actuator.

20 Claims, 4 Drawing Sheets

ELECTROMAGNETIC RELAY

PRIOR HISTORY

This application is a Continuation-In-Part application of U.S. patent application Ser. No. 09/244,925 filed on Feb. 4, 1999 now abandoned.

BACKGROUND OF THE INVENTION

1. Field of the Invention

The present invention relates generally to electromagnetic relays, more particularly, to a miniature power switching relay specifically designed for mounting on printed circuit boards.

2. Description of the Prior Art

Electromagnetic switching devices, commonly referred to as relays, have been used for many years and there is a continuing need for such a device which is small in size. Yet, moreover, capable of reliably handling relatively high current switching jobs. This requirement for miniaturization together with reliability has become particularly important in recent years because of the increasingly common practice of mounting relays on printed circuit boards.

In the design of an electromagnetic relay and other such electromagnetic devices an important consideration is the design of the "magnetic circuit." The design of an effective magnetic circuit determines to a great extent the current switching capability of the relay and the power needed to operate it. The magnetic circuit of a relay generally includes the core of the relay coil, the relay frame, the armature that moves directly or indirectly through an actuator, and the relay contacts. In addition, the air gaps exist where the core of the relay coil and the armature interface with the relay frame and most importantly between the armature and the core of the coil at an exposed end.

In relay operation electrical current is sent throughout the relay coil. The current running throughout the relay coil sets up a magnetic field in this magnetic circuit and it is the strength of the magnetic field generated in the air gap between the armature and the core of the relay coil at an exposed end that is the force that causes the armature to move into contact with the core of the relay coil at an exposed end therefore, providing the motion to operate the switching of the relay contacts. In the relay, the core of the relay coil, the frame and armature are made of materials that can be easily magnetized. The air gaps, however, resist the establishment of a magnetic field, and the air gap between the armature and the core of the coil has by far the most significant resistance to a magnetic field in the magnetic circuit. In obtaining switching capability for the relay, it is desirable to design effective contact travel distances and rapid movement of the contacts by the armature. It is also desirable to provide the strongest possible magnetic field at this armature gap for the available coil current. This provides for positive and rapid contact movement thus permitting the use of a strong return spring. A strong return spring allows for return movement of the armature when the relay current is removed causing positive and rapid contact movement.

Therefore, the mechanical arrangement of the magnetic coil core, relay armature, resulting air gap and the design of their interfaces significantly affect the ability of the relay to perform its function as an electrical switching device. It is desirable to maintain a minimum air gap between the core and armature. This air gap must be tailored to the design of the relays function achieving the intended movement needed to move the movable contact or contacts the required distance for proper contact switching.

The present invention fulfills the need for a device which is small in size, yet capable of reliably handling high current switching jobs relative to known designs. The present invention solves the high current problem in a small size by using a combination contact assembly. This contact assembly contains a blade and a terminal.

It is known that bi-metal contact assemblies are used in electromagnetic relays. These known electromagnetic relays use bronze and brass materials for the blade and terminal. In addition, the blade and terminal are spot welded together.

A problem with the known brass and bronze materials is that these materials have low current conductivity properties. In addition, spot welding produces a limited contact area for the electrical current to flow through between the blade and the terminal resulting in lower current handling potential.

Accordingly, there is a need for an electromagnetic relay that is small in size yet capable of handling high current switching.

Accordingly there is also a need for an electromagnetic relay with a contact assembly comprised of more conductive material than brass and bronze and having a greater contact surface between the blade and the terminal.

The present invention solves both of these problems. First, the blade and terminal are made of high current conductive materials namely copper alloy and oxygen free copper. Secondly, the parts are ultrasonically welded together which produces a large contact area between the blade and the terminal resulting in higher current handling potential. Therefore, by using materials with high conductivity properties and increasing the contact area between the terminal and the blade the present invention can handle higher currents while maintaining a relatively small overall package size.

As will be described in greater detail hereinafter, the present invention solves the aforementioned and employs a number of novel features that render it highly advantageous over the prior art.

SUMMARY OF THE INVENTION

Accordingly it is an object of this invention to provide an electromagnetic relay that is small in size yet capable of handling high current switching.

A further object of the present invention is to provide an electromagnetic relay with a contact assembly comprised of more conductive material than brass and bronze and having a greater contact surface between the blade and the terminal.

To achieve these objectives, and in accordance with the purposes of the present invention the following electromagnetic relay is presented.

The electromagnetic relay has a motor assembly with a bobbin secured to a frame. A core is disposed within the bobbin except for a core end which extends from the bobbin.

An armature has a first armature end, a second armature end and an armature elbow. The armature elbow engages the top of the frame and remains engaged to the top of the frame by way of an armature retaining spring. The first armature end magnetically engages a core end when the coil is energized.

A first actuator end of an actuator engages the armature at the second armature end. The second actuator end engages a plurality of movable blade assemblies.

A movable blade assembly is comprised of a movable blade ultrasonically welded onto a center contact terminal.

Each movable blade has a first contact rivet and a rib. The contact rivet extends through the movable blade and has a first contact surface on one side of the movable blade and a second contact surface on the other side of the movable blade. The rib provides stability and support to the area of the movable blade where the second actuator end engages the movable blade. A first slot is cut through the movable blade in order to reduce the cross section of the blade, allowing lower electrical power consumption.

A normally open blade is positioned relatively parallel to a movable blade. The vertical distance between the movable blade and the normally open blade dependent upon the contact gap requirement for the particular relay. The normally open blade has a second contact rivet, the second contact rivet positioned opposing the first contact surface of the first contact rivet. A second slot is cut through the normally open blade in order to reduce the cross section of the blade, allowing lower electrical power consumption. The normally open blade is ultrasonically welded onto a normally open terminal to form a normally open contact assembly.

A normally closed contact assembly comprised of a third contact rivet and a normally closed terminal. The third contact rivet is positioned relatively parallel to the second contact surface of a movable blade. The normally closed contact assembly is vertically positioned with respect to a movable blade so that the third contact rivet is in contact with the second contact surface when the movable blade is not being acted upon by the actuator.

When energized, the terminals of the motor assembly accept a current that runs throughout the coil causing a magnetic field that magnetizes the core. The core end then draws the first armature end into contact with the core end causing the actuator to apply a force on the movable blade which bends the movable blade breaking contact with the normally closed contact assembly and establishing contact with the normally open blade.

When the coil is not energized the armature is disengaged from the core end and no force is applied to the movable blade. The movable blade returns to its original position, reestablishing contact with third contact rivet of the normally closed contact assembly.

The present invention has advantages that permit the device to successfully transfer higher currents while maintaining a relatively small overall package size. First, the movable blade and the normally open blade are made from a copper alloy and the center contact terminal and the normally open terminal are made from an oxygen free copper, materials which are more conductive than those typically used in the prior art. Secondly, the use of ultrasonic welding techniques increases the contact area between a blade and the terminal allowing a greater current flow between a blade and a terminal.

DESCRIPTION OF THE PREFERRED EMBODIMENT

The present invention is an electromagnetic relay which has a contact assembly capable of handling current switching operations with higher current flow while maintaining a small overall package size.

Figure 1:
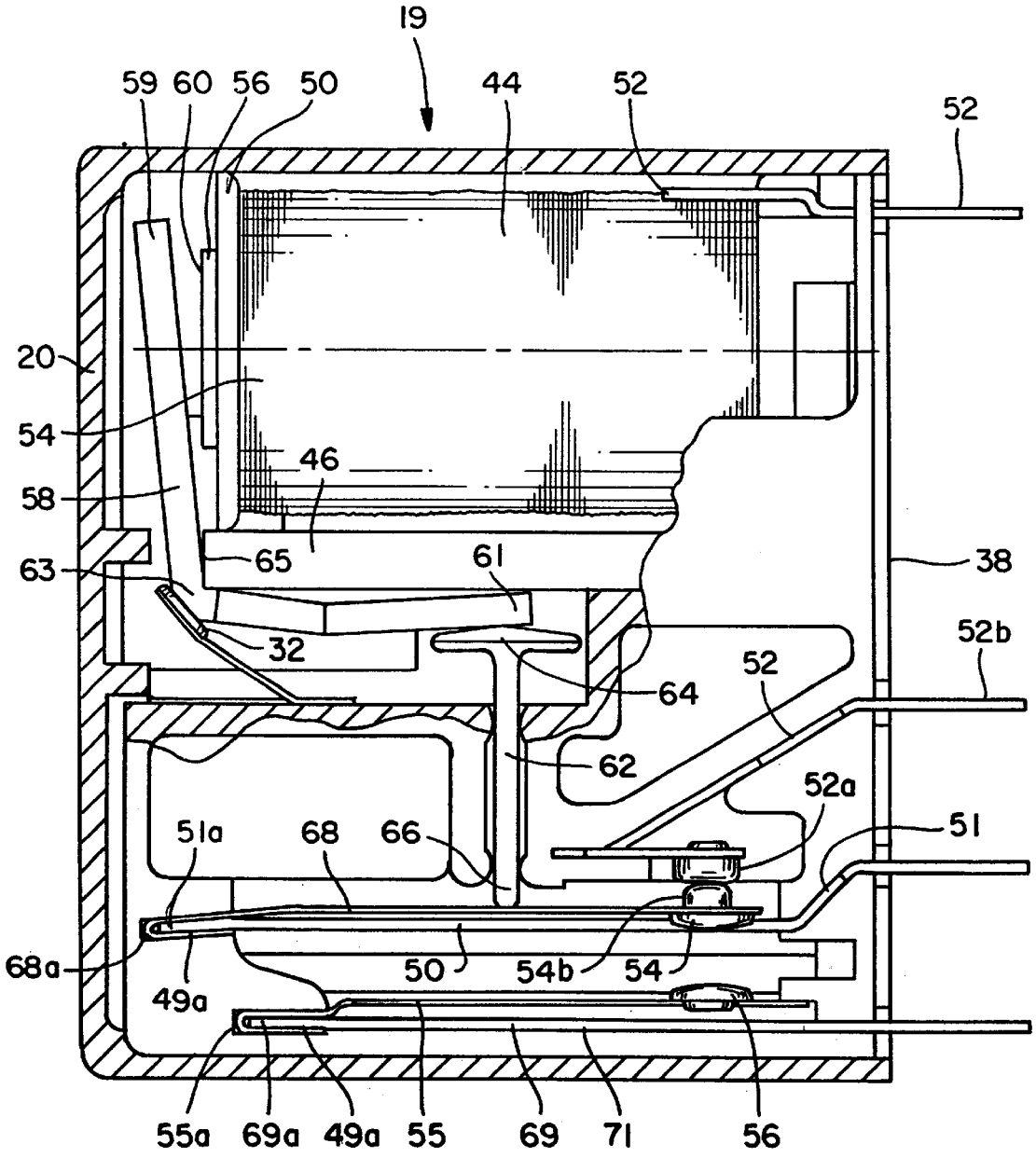
FIG. 1 is a side view of a completed electromagnetic relay constructed in accordance with the principals of the present invention wherein the electromagnetic relay device is in a de-energized state in an opened position illustrating important features of the invention.
Figure 2:
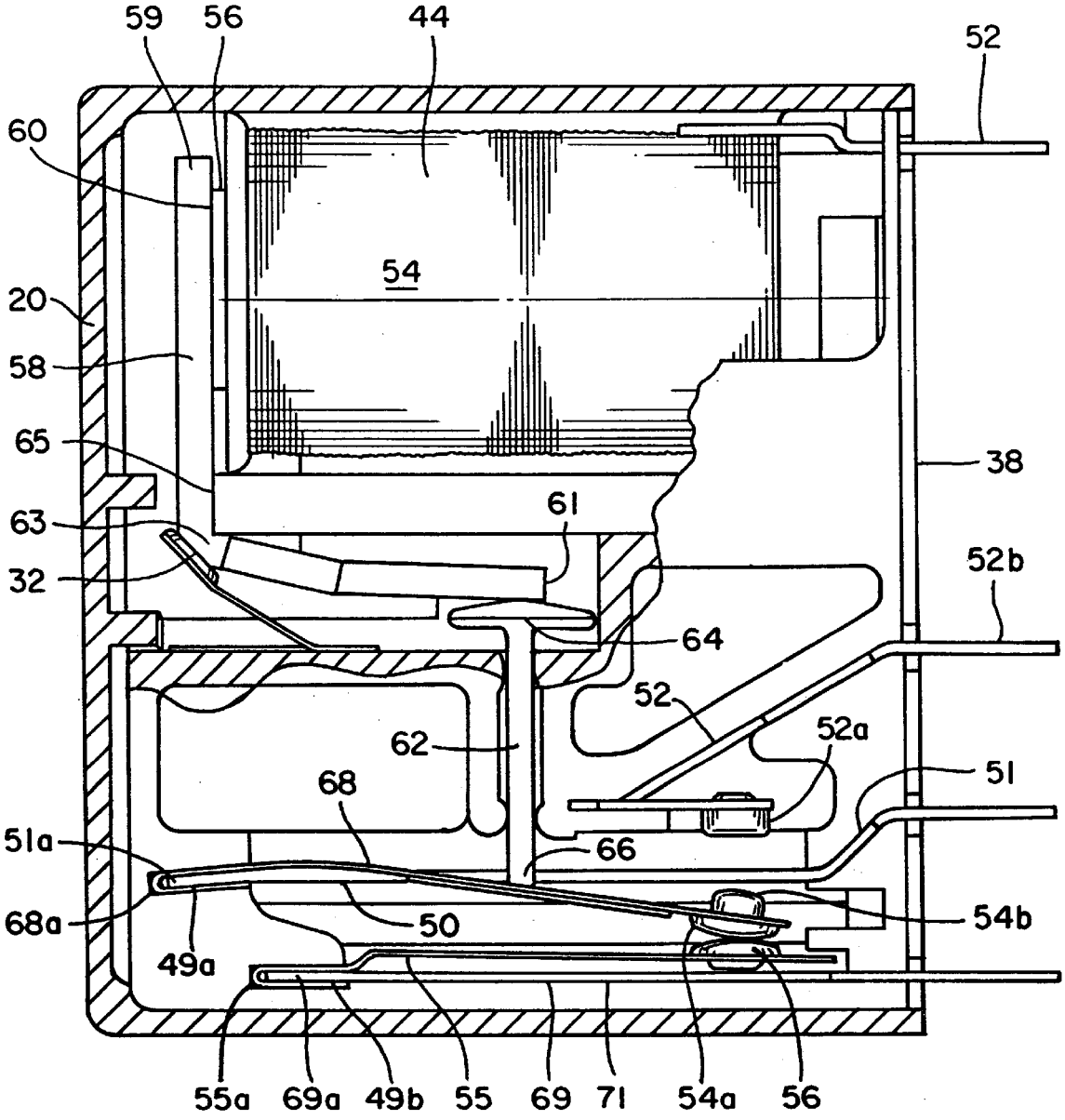
FIG. 2 is a side view of a completed electromagnetic relay constructed in accordance with the principals of the present invention wherein the electromagnetic relay device is in an energized state in a closed position illustrating important features of the invention.
Figure 3:
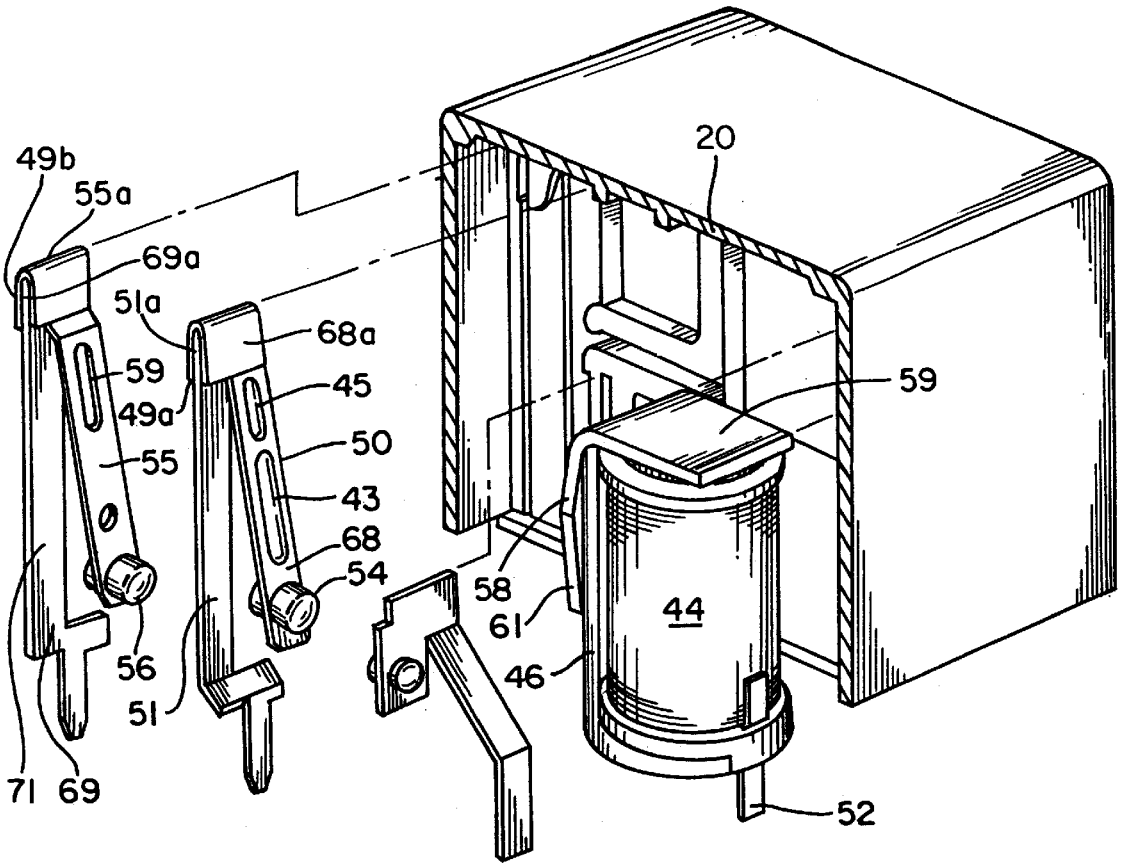
FIG. 3 is an exploded view of a completed electromagnetic relay constructed in accordance with the principals of the present invention.
Figure 4:
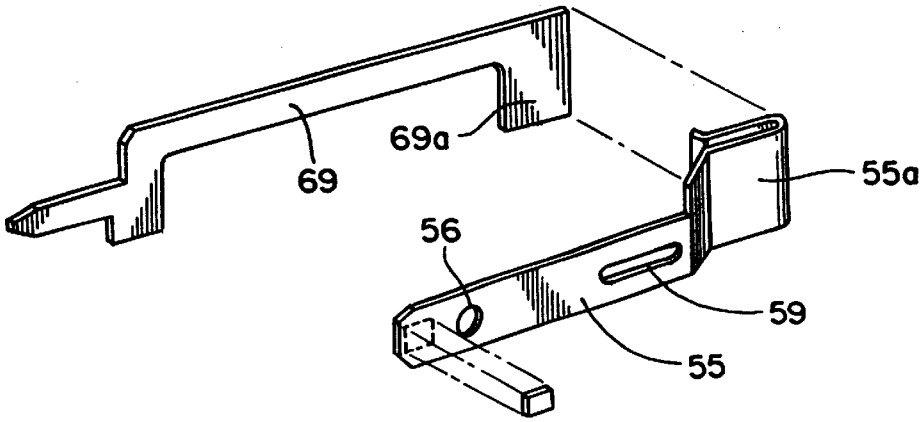
FIG. 4 is an exploded view of a normally open contact assembly wherein components are shown.
Figure 5:
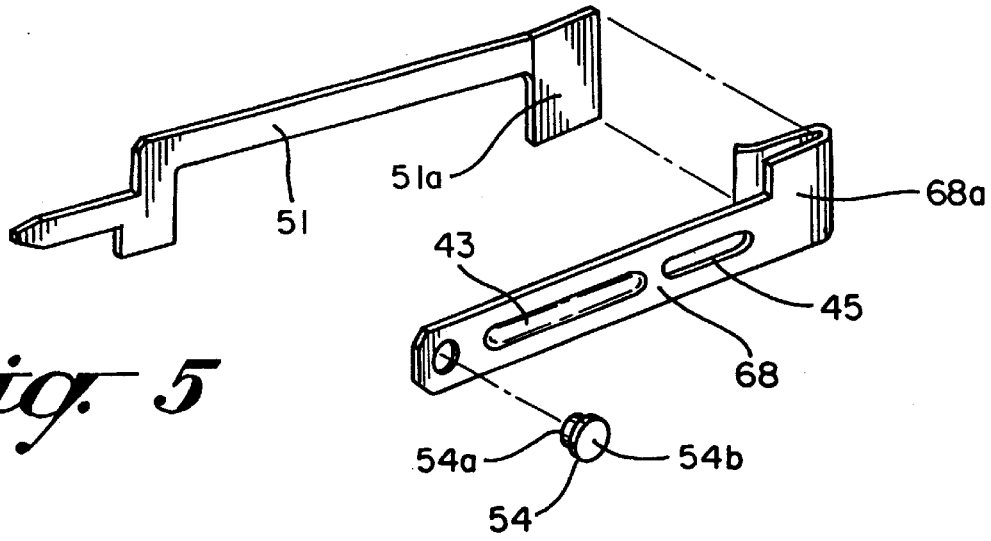
FIG. 5 is an exploded view of a movable blade assembly wherein components are shown.
Figure 6:
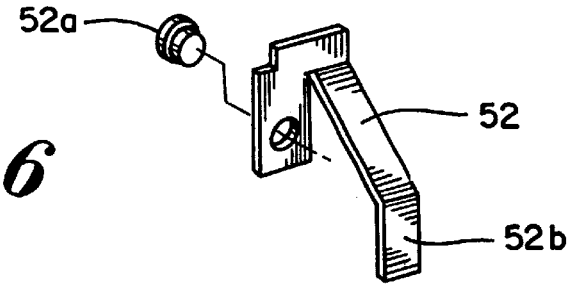
FIG. 6 is an exploded view of a normally closed contact assembly wherein components are shown.
Figure 7:
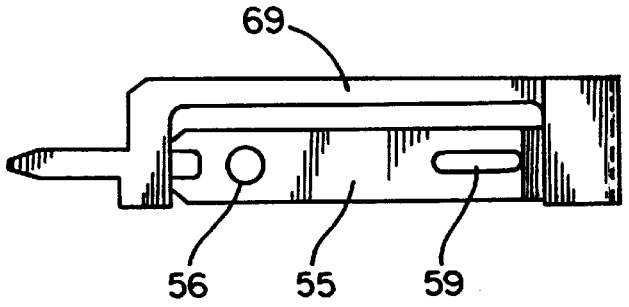
FIG. 7 is a bottom view of a normally open contact assembly of the electromagnetic relay constructed in accordance with the principals of the present invention wherein the assemblies illustrate important features of the invention.
Figure 8:
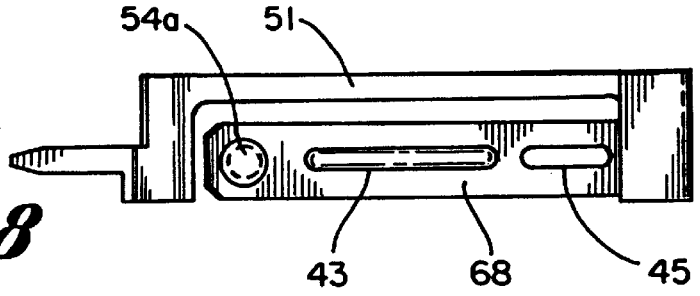
FIG. 8 is a bottom view of a movable blade assembly of the electromagnetic relay constructed in accordance with the principals of the present invention wherein the assemblies illustrate important features of the invention.

Referring to FIGS. 1, 2, and 3, the electromagnetic relay 19 has a motor assembly 44 with a bobbin 50 secured to a frame 46. In the preferred embodiment, the bobbin 50 is made from a thermoplastic material. The bobbin 50 is wound with a copper wire producing a coil 54. A plurality of terminals 52 are pressed into the bobbin 50. The ends of the copper wire are attached to the terminals 52. A core 56 is disposed within the bobbin 50 except for a core end 60 which extends from the bobbin 50. The core 56 is made of a magnetic material.

An armature 58 has a first armature end 59, a second armature end 61 and an armature elbow 63. The armature elbow 63 engages a top of the frame 65 and remains engaged to the top of the frame 65 by way of an armature retaining spring 32. The first armature end 59 magnetically engages a core end 60 when the coil 54 is energized. A first actuator end 64 of an actuator 62 engages the armature 58 at the second armature end 61. The second actuator end 66 engages a plurality of movable blade assemblies 50.

Referring to FIGS. 1, 2, 3, 5 and 8, each movable blade assembly 50 is comprised of a movable blade 68 ultrasonically welded onto a center contact terminal 51. The movable blade has a first U-shaped end 68*a* in which the first welded end of 51*a* of the center contact terminal 51 is disposed within. The first U-shaped end 68*a* and the first welded end 51*a* are ultrasonically welded to each other to form a first U-shaped weld 49*a*welding the movable blade to the center contact terminal. In the preferred embodiment, there are two movable blade assemblies 50 in an electromagnetic relay 19.

Each movable blade 68 has a first contact rivet 54, and a rib 43. The first contact rivet 54 extends through the movable blade and has a first contact surface 54*a* on one side of the movable blade 68 and a second contact surface 54*b* on the other side of the movable blade 68. The movable blade 68 also has a rib 43, the rib 43 providing stability and support to the area of the movable blade 68 where the second actuator end 66 engages the movable blade 68. A first slot 45 is cut through the movable blade 68 in order to reduce the cross section of the blade, allowing lower electrical power consumption.

Referring to FIGS. 1, 2, 4 and 7, a normally open blade 55 is positioned relatively parallel to a movable blade 68. The vertical distance between the movable blade 68 and the normally open blade 55 dependent upon the contact gap requirement for the particular relay. The normally open blade 55 has a second contact rivet 56, the second contact rivet positioned opposing the first contact surface 54*a* of the first contact rivet 54. A second slot 59 is cut through the normally open blade 55 in order to reduce the cross section of the blade, allowing lower electrical power consumption.

The normally open blade 55 is ultrasonically welded onto a normally open terminal 69 to form a normally open contact assembly 71. The normally open blade 55 has a second U-shaped end 55*a* and the normally open terminal 69 has a second welded end 69*a* disposed within the second U-shaped end 55*a*. The second U-shaped end 55*a* and the second welded end 69*a* are ultrasonically welded to each other to form a second U-shaped weld 49*b* welding the normally open blade to the normally open terminal.

A normally closed contact assembly 52 is comprised of a third contact rivet 52*a* and a normally closed terminal 52*b*. The third contact rivet 52*a* is positioned relatively parallel to the second contact surface 54*b* of a movable blade 68. The normally closed contact assembly 52 is vertically positioned with respect to a movable blade 68 so that the third contact rivet 52*a* is in contact with the second contact surface 54*b* when the movable blade 68 is not being acted upon by the actuator 62.

In the preferred embodiment, the electromagnetic relay device 19 is housed in a housing comprised of a cover 20 and a base 38. The cover 20 and the base 38 is made from a thermoplastic material, and a sealing compound is used to seal the cover 20 to the base 38. The cover and the base not only serves to protectively encase the electromagnetic relay but it also provides positional and structural support to the components which comprise the electromagnetic relay.

Referring to FIG. 2, when energized, the terminals 52 of the motor assembly 44 accept a current that runs throughout the coil 54 causing a magnetic field that magnetizes the core 56. The core end 60 draws the first armature end 59 into contact with the core end 60 causing the actuator 62 to apply a force on the movable blade 68 which bends the movable blade 68, breaking contact with the normally closed contact assembly 52 and establishing contact with the normally open blade 55.

Referring to FIG. 1, when the coil 54 is not energized the armature 58 is disengaged from the core end 60 and no force is applied to the movable blade 68 causing the movable blade 68 to return to its original position, the movable blade 68 reestablishing contact with third contact rivet 52*a* of the normally closed contact assembly 52.

The present invention has advantages that permit the device to successfully transfer higher currents while maintaining a relatively small overall package size. First, the movable blade 68 and the normally open blade 55 are made from a copper alloy and the center contact terminal and the normally open terminal 69 are made from an oxygen free copper (pure copper). Prior art electromagnetic relays typically use bronze and brass materials for the blade and terminal. Copper alloy and oxygen free copper are more conductive materials so they are able to handle greater current flow. In the preferred embodiment, the copper alloy is composed of 0.3% Cr, 0.1% Ti, 0.02% Si, and the balance being Cu. This composition has a conductivity which is roughly 75% of pure copper. However, a copper alloy having a conductivity which is at least 50% of the conductivity of pure copper, or greater, may also be used.

Secondly, in the prior art, blades and terminals are joined by spot welding (otherwise called resistance welding) the two together. The contact area through which the electric current flows between the blade and terminal is limited to the area of the spot weld joint. Resistance welding is particularly difficult to do when the two materials to be joined are made of highly conductive material such as copper. Consequently, less conductive materials like brass and bronze were typically used in the construction of prior art relays in order to make the spot welding process easier and less costly.

Ultrasonic welding techniques involve the use of high frequency vibrations and a compressing force to anneal the copper materials together. The use of ultrasonic welding techniques allows the contact area between a blade and a terminal to be expanded to the entire surface area where the blade and the terminal are indirect contact. In the preferred embodiment, the surface area between the movable blade 68 and the center contact terminal and also between the normally open blade 55 and the normally open terminal is expanded by having a U-shaped end on both the movable blade 68 and the normally open blade 55. By using ultrasonic welding, the expanded surface area between the movable blade 68 and the center contact terminal and also between the normally open blade 55 and the normally open terminal results in greater contact area. The greater the contact area between a blade and a terminal, the larger the current that can be transferred between a blade and a terminal.

Therefore, by using materials with high conductivity properties and increasing the contact area between the blade and the terminal, the present invention can handle higher currents while maintaining a relatively small overall package size. In the preferred embodiment, the electromagnetic relay 19 is PC board mountable with a depth of 28.85 mm, a height of 26.50 mm, and a width of 12.7 mm. In the preferred embodiment, the electromagnetic relay is capable of transferring 8 amps with a contact gap of 1.5 mm. The electromagnetic relay is also capable of transferring 12 amps with a contact gap of 0.5 mm when the slots 45 and 59 are omitted.

The foregoing descriptions of the preferred embodiments of the invention have been presented for purposes of illustration and description, and are not intended to be exhaustive or to limit the invention to the precise forms disclosed. The descriptions were selected to best explain the principles of the invention and their practical application to enable others skilled in the art to best utilize the invention in various embodiments and various modifications as are suited to be particular use contemplated. It is not intended that the novel device be limited thereby. The preferred embodiment may be susceptible to modifications and variations that are within the scope and fair meaning of the accompanying claims and drawings.

I claim:

1. An electromagnetic relay device comprising:

a relay motor, the relay motor having a magnetic core disposed therein, the magnetic core having a core end extending from the relay motor;

an armature, the armature having a first armature end and a second armature end, the first armature end magnetically coupled to the core end;

an actuator, the actuator having a first actuator end and a second actuator end, the first actuator end operatively coupled to the second armature end;

a movable blade assembly, the movable blade assembly having a movable blade made of a copper alloy with a conductivity of 50% the conductivity of pure copper or greater, and a center contact terminal made of an oxygen free copper, the movable blade having a first U-shaped end, a rib, and a first contact rivet with a first contact surface and a second contact surface, the center contact terminal having a first welded end disposed within the first U-shaped end, the first U-shaped end and the first welded end ultrasonically welded to each other forming a first U-shaped weld spanning the area between the first U-shaped end and the first welded end creating a contact surface area spanning the entire U-shaped weld allowing for greater current flow between the movable blade and the center contact terminal, the movable blade assembly operatively coupled to the second actuator end at the rib, the rib providing stability and support to the movable blade;

a normally open contact assembly, the normally open contact assembly having a normally open blade made of a copper alloy with a conductivity of 50% the conductivity of pure copper or greater, and a normally open terminal made of oxygen free copper, the normally open blade having a second U-shaped end and a second contact rivet, the normally open terminal having a second welded end disposed within the second U-shaped end, the second U-shaped end and the second welded end ultrasonically welded to each other forming a second U-shaped weld spanning the area between the first U-shaped end and the first welded end creating a contact surface area spanning the entire second U-shaped weld allowing for greater current flow between the normally open blade and the normally open terminal, the normally open blade positioned relatively parallel to the movable blade with the second contact rivet positioned opposite the first contact surface of the first contact rivet, the normally open blade vertically positioned with respect to the movable blade assembly so that the first contact surface of the first contact rivet touches the second contact rivet when the movable blade is acted upon by the actuator;

the normally closed contact assembly, the normally closed contact assembly has a third contact rivet and a normally closed terminal, the normally closed contact assembly is vertically positioned with respect to the movable blade so that the third contact rivet is in contact with the second contact surface of the first contact rivet when the movable blade is not being acted upon by the actuator; and a housing, the housing having the relay motor, the actuator, the movable blade assembly, the normally open contact assembly, and the normally closed contact assembly disposed therein.

2. The electromagnetic relay device defined in claim 1 wherein the movable blade of the movable blade assembly has a first slot therethrough, and the normally open blade of the normally open contact assembly has a second slot therethrough, the first slot and the second slot reducing the cross section of the movable blade and the normally open blade reducing the electrical power consumption of the electromagnetic relay device.

3. An electromagnetic relay device comprising:

a relay motor;

an armature, the armature having a first armature end and a second armature end, the first armature end coupled to the relay motor;

an actuator, the actuator having a first actuator end and a second actuator end, the first actuator end operatively coupled to the second armature end;

a movable blade assembly, the movable blade assembly having a movable blade made of a copper alloy with a conductivity which is 50% or greater of the conductivity of pure copper and a center contact terminal made of oxygen free copper, the movable blade and the center contact terminal each having end portions which are ultrasonically welded to each other forming a weld spanning the area between the end portions allowing for greater current flow between the normally open blade and the normally open terminal, the movable blade assembly operatively coupled to the second actuator end; and a normally open contact assembly, the normally open contact assembly having a normally open blade made of a copper alloy with a conductivity which is 50% or greater of the conductivity of pure copper and a normally open terminal made of oxygen free copper, the normally open blade and the normally open terminal each having end portions which are ultrasonically welded to each other forming a weld spanning the area between the end portions allowing for greater current flow between the normally open blade and the normally open terminal, the normally open blade positioned relatively parallel to the movable blade, the normally open blade vertically positioned with respect to the movable blade assembly so that the first contact surface of the first contact rivet touches the second rivet when the movable blade is acted upon by the actuator.

4. The electromagnetic relay device defined in claim 3 wherein the movable blade has a first U-shaped end, the center contact terminal having a first welded end disposed within the first U-shaped end, the first U-shaped end and the first welded end ultrasonically welded to each other forming a first U-shaped weld spanning the area between the first U-shaped end and the first welded end creating a contact surface area spanning the entire U-shaped weld allowing for greater current flow between the movable blade and the center contact terminal.

5. The electromagnetic relay device defined in claim 4 wherein the normally open blade has a second U-shaped end, the normally open terminal having a second welded end disposed within the second U-shaped end, the second U-shaped end and the second welded end ultrasonically welded to each other forming a second U-shaped weld spanning the area between the first U-shaped end and the first welded end creating a contact surface area spanning the entire second U-shaped weld allowing for greater current flow between the normally open blade and the normally open terminal.

6. The electromagnetic relay device in claim 5 wherein the movable blade and the normally open blade is made from a copper alloy having a chemical composition of 0.3% Cr, 0.1% Ti, 0.02% Si, and the balance Cu.

7. The electromagnetic relay device defined in claim 6 wherein the movable blade of the movable blade assembly has a first slot therethrough, and the normally open blade of the normally open contact assembly has a second slot therethrough, the first slot and the second slot reducing the cross section of the movable blade and the normally open blade reducing the electrical power consumption of the electromagnetic relay device.

8. The electromagnetic relay device defined in claim 7 further comprising a normally closed contact assembly, the normally closed contact assembly has a third contact rivet and a normally closed terminal, the normally closed contact assembly is vertically positioned with respect to a movable blade so that the third contact rivet is in contact with the second contact surface of the first contact rivet of the movable blade when the movable blade is not being acted upon by the actuator.

9. An electromagnetic relay device comprising:

a relay motor;

an armature, the armature having a first armature end and a second armature end, the first armature end coupled to the relay motor;

an actuator, the actuator having a first actuator end and a second actuator end, the first actuator end operatively coupled to the second armature end;

a movable blade assembly, the movable blade assembly having a movable blade made of a copper alloy with a conductivity which is 50% of the conductivity of pure copper or greater and a center contact terminal made of oxygen free copper, the movable blade and the center contact terminal each having end portions which are ultrasonically welded to each other forming a weld spanning the area between the end portions allowing for greater current flow between the normally open blade and the normally open terminal, the movable blade assembly operatively coupled to the second actuator end; and a housing, the housing having the relay motor, the armature, the actuator, the movable blade assembly, and the normally open blade disposed therein.

10. The electromagnetic relay device defined in claim 9 further comprising a normally closed contact assembly, the normally closed contact assembly has a third contact rivet and a normally closed terminal, the normally closed contact assembly is vertically positioned with respect to the movable blade so that the third contact rivet is in contact with the movable blade when the movable blade assembly is not being acted upon by the actuator.

11. The electromagnetic relay device defined in claim 9 wherein the movable blade has a rib, and a first contact rivet with a first contact surface and a second contact surface.

12. The electromagnetic relay device in claim 9 wherein the movable blade is made from a copper alloy having a chemical composition of 0.3% Cr, 0.1% Ti, 0.02% Si, and the balance Cu.

13. The electromagnetic relay device defined in claim 9 wherein the movable blade has a first U-shaped end, the center contact terminal having a first welded end disposed within the first U-shaped end, the first U-shaped end and the first welded end ultrasonically welded to each other forming a first U-shaped weld spanning the area between the first U-shaped end and the first welded end creating a contact surface area spanning the entire U-shaped weld allowing for greater current flow between the movable blade and the center contact terminal.

14. The electromagnetic relay device in claim 9 further comprising a normally open contact assembly, the normally open contact assembly having a normally open blade made of a copper alloy with a conductivity which is 50% of the conductivity of pure copper or greater and a normally open terminal made of oxygen free copper, the normally open blade and the normally open terminal each having end portions which are ultrasonically welded to each other forming a weld spanning the area between the end portions allowing for greater current flow between the normally open blade and the normally open terminal, the normally open blade positioned relatively parallel to the movable blade, the normally open blade vertically positioned with respect to the movable blade assembly so that the movable blade contacts the normally open blade when the movable blade is acted upon by the actuator.

15. The electromagnetic relay device in claim 14 wherein the normally open blade and the movable blade are made from a copper alloy having a chemical composition of 0.3% Cr, 0.1% Ti, 0.02% Si, and the balance.

16. The electromagnetic relay device defined in claim 14 wherein the movable blade has a first U-shaped end, the center contact terminal having a first welded end disposed within the first U-shaped end, the first U-shaped end and the first welded end ultrasonically welded to each other forming a first U-shaped weld spanning the area between the first U-shaped end and the first welded end creating a contact surface area spanning the entire U-shaped weld allowing for greater current flow between the movable blade and the center contact terminal.

17. The electromagnetic relay device defined in claim 14 wherein the normally open blade has a second U-shaped end, the normally open terminal having a second welded end disposed within the second U-shaped end, the second U-shaped end and the second welded end ultrasonically welded to each other forming a second U-shaped weld spanning the area between the first U-shaped end and the first welded end creating a contact surface area spanning the entire second U-shaped weld allowing for greater current flow between the normally open blade and the normally open terminal.

18. The electromagnetic relay device defined in claim 14 wherein the movable blade of the movable blade assembly has a first slot therethrough, and the normally open blade of the normally open contact assembly has a second slot therethrough, the first slot and the second slot reducing the surface area of the movable blade and the normally open blade reducing the electrical power consumption of the electromagnetic relay device.

19. The electromagnetic relay device defined in claim 14 further comprising a normally closed contact assembly, the normally closed contact assembly has a third contact rivet and a normally closed terminal, the normally closed contact assembly is vertically positioned with respect to the movable blade so that the third contact rivet is in contact with the movable blade when the movable blade assembly is not being acted upon by the actuator.

20. An electromagnetic relay device comprising:

a relay motor, an armature, the armature coupled to the relay motor;

an actuator, the actuator operatively coupled to the armature; and a movable blade assembly, the movable blade assembly having a movable blade with a U-shaped end, the movable blade assembly further having a center contact terminal with a welded end, the welded end disposed within the U-shaped end, the movable blade assembly operatively coupled to the actuator, the U-shaped end and the welded end are ultrasonically welded to each other forming a U-shaped weld spanning the area between the U-shaped end and the welded end creating a contact surface area spanning the U-shaped weld allowing for greater current flow between the movable blade and the center contact terminal.

* * * * *